US006758944B2

(12) United States Patent
Kirjava et al.

(10) Patent No.: US 6,758,944 B2
(45) Date of Patent: Jul. 6, 2004

(54) DOCTOR BLADE

(75) Inventors: Jouni Kirjava, Ruutana (FI); Ilkka Rata, Jyväskylä (FI); Tommi Vainio, Vantaa (FI)

(73) Assignee: Metso Paper, Inc., Helsinki (FI)

( * ) Notice: Subject to any disclaimer, the term of this patent is extended or adjusted under 35 U.S.C. 154(b) by 88 days.

(21) Appl. No.: 09/803,464

(22) Filed: Mar. 9, 2001

(65) Prior Publication Data

US 2001/0052401 A1 Dec. 20, 2001

Related U.S. Application Data

(63) Continuation of application No. PCT/FI99/00729, filed on Sep. 9, 1999.

(30) Foreign Application Priority Data

Sep. 10, 1998 (FI) ..... 981945

(51) Int. Cl.[7] ..... D21G 3/04

(52) U.S. Cl. ..... 162/281; 162/272; 15/256.51

(58) Field of Search ..... 162/111, 273, 162/274–276, 199, 281–282, 280; 15/256.5, 256.51, 256.53; 118/413, 261; 101/425; 198/497–499

(56) References Cited

U.S. PATENT DOCUMENTS

| | | | | | |
|---|---|---|---|---|---|
| 3,876,726 | A | * | 4/1975 | Ford et al. | 525/28 |
| 4,182,830 | A | * | 1/1980 | Ford, Jr. | 528/75 |
| 4,287,116 | A | * | 9/1981 | Burns | |
| 4,549,933 | A | | 10/1985 | Judd et al. | |
| 4,824,919 | A | * | 4/1989 | Baker et al. | 525/502 |
| 5,017,643 | A | | 5/1991 | Snelling et al. | |
| 5,110,415 | A | * | 5/1992 | Boucher et al. | 162/281 |
| 6,416,843 | B1 | * | 7/2002 | Rata et al. | 162/281 |

FOREIGN PATENT DOCUMENTS

| | | |
|---|---|---|
| DE | 40 12 946 A1 | 10/1991 |
| DE | 41 37 970 A1 | 5/1993 |
| EP | 0 448 043 A1 | 9/1991 |
| EP | 0 454 404 A1 | 10/1991 |
| JP | 62-62145 | 3/1987 |
| JP | 63-270889 | 11/1988 |
| JP | 4-227642 | 8/1992 |
| JP | 4-228695 | 8/1992 |
| JP | 5-132691 | 5/1993 |
| JP | 5-214696 | 8/1993 |
| JP | 5-321189 | 12/1993 |
| JP | 6-280186 | 10/1994 |
| WO | WO 98/04091 | 1/1999 |
| WO | WO 99/04091 | 1/1999 |
| WO | WO 99/12726 | 3/1999 |

OTHER PUBLICATIONS

Southwest Research Institute 1997 Annual Report, Polymer Research and Coatings Technology, 1997.*
Condensed Chemical Dictionary, p. 1016, Van Nostrand Reinhold Company, 1981.*
www.ivw.usi–kl.de—"Hybrid Resins" no date.*

* cited by examiner

*Primary Examiner*—Peter Chin
*Assistant Examiner*—Eric Hug
(74) *Attorney, Agent, or Firm*—Stiennon & Stiennon

(57) ABSTRACT

A doctor blade for use in cleaning a roll in a paper machine comprises a thermosetting plastic polymer material selected from the group consisting of vinylesterurethanes and polyether amides.

14 Claims, No Drawings

DOCTOR BLADE

CROSS REFERENCES TO RELATED APPLICATIONS

This application is a continuation of PCT Application No. PCT/F199/00729, filed on Sep. 9, 1999, which is incorporated herein by reference, and claims priority on Finnish application No. 981945, filed Sep. 10, 1998.

STATEMENT AS TO RIGHTS TO INVENTIONS MADE UNDER FEDERALLY SPONSORED RESEARCH AND DEVELOPMENT

Not applicable

BACKGROUND OF THE INVENTION

The present invention relates to a doctor blade for a papermaking machine in general and to a doctor blade constructed of plastic in particular.

Faces of rolls in a paper/board machine tend to be coated with impurities derived from the papermaking process. Doctor blades are used in order to remove these materials from roll faces. As the running speed of paper machines has increased, the amount of friction between the doctor blade and the roll face has also increased, resulting in increased temperature at the doctor blade/roll interface and of the doctor blade itself. This is a problem, because the materials conventionally used in doctor blades do not withstand such higher speeds. For example, at a paper machine speed greater than 1400 meters per minute, doctor blades made of conventional materials can start to melt and abrade rapidly, in which case they no longer operate in cleaning of the roll face.

From the prior art, many doctor blades made of different materials are known, including composite structures. In U.S. Pat. No. 4,549,933, a doctor blade for a paper machine is described, which blade consists of a number of alternating layers of fibre and carbon fibre. The fibre layer can consist of cotton, paper, fibreglass, or equivalents thereof.

On the other hand, in published German patent application DE 4137970, a doctor blade comprising fiber-reinforced plastic is suggested. The fibre-reinforced plastic contains from 60 to 90 per cent by weight of polyamide-6 or polyamide-66, and from 10 to 40 per cent by weight of reinforcement fibers. A polyamide, which is a thermoplastic resin, is used in order to increase the thermal conductivity of the blade.

In Finnish Patent FI 101,637, a caring doctor blade is described, which blade comprises a number of fibre layers in a laminate construction, where at least one layer of carbon fibre or at least one layer that contains a substantial proportion of carbon fibre is present. This patent further discloses that the blade contains grinding particles in direct vicinity of the carbon fibers and that the carbon fibers are oriented substantially obliquely in relation to the direction of the longitudinal axis of the blade, preferably in the cross direction of the blade.

Japanese Published Application JP 05-214696, discloses a doctor blade comprising polyethylene of very high molecular weight or fibre-reinforced polyethylene of very high molecular weight, which polyethylene is a thermoplastic resin.

Japanese Published Application JP 05-32118 describes a doctor blade which is made of a thermoplastic fibre composite material which contains from 30 to 80 percent by weight of polyphenylene sulphide (a thermoplastic resin), and from 20 to 70 percent by weight of either glass fibers, aramide fibers, or graphite fibers.

Finally, Japanese Published Application JP 05-13289 discloses a doctor blade which consists of a material that contains fibreglass, where the filament fibres have been immobilized in a resin parent material, such as epoxy resin.

As evidenced by the above prior art, a number of different thermoplastic resin materials have been suggested for use in a doctor blade. In spite of their desirable heat resistance properties, thermoplastic resins have not achieved commercial importance as doctor blade materials because of their high cost and because of their difficult workability. A thermosetting plastic from which high resistance to heat in operation is expected also requires a considerably high melting-processing temperature. In practice, in commercial products, epoxy resins have been used almost exclusively.

However, doctor blades that comprise an epoxy matrix tend to wear, or degrade rapidly, resulting in shorter service life. As machine running speeds increase, this problem has become even worse. As discussed earlier, higher machine operation speed increases the friction heat between the revolving roll and the doctor blade. This heat causes the epoxy in the doctor blade to soften and start to melt. The phenomenon of softening is increased by the wet conditions, for epoxy has a certain degree of tendency to absorb water. The softening and the melting have the effect that the roll face becomes coated with the blade material. This causes changes in the properties of adhesion, separation and surface energy in the roll face, which has a very detrimental effect on the operation of the papermaking machine.

A second serious drawback of epoxy is its poor suitability for pultrusion and for similar methods that would allow continuous manufacture of doctor blades.

Thus, it is an object of the present invention to provide such a material for a doctor blade that can endure high paper machine running speeds and, thus, high operating temperatures at the doctor blade/roll interface.

It is an additional object of the present invention to provide a doctor blade which can withstand high operating temperatures, and also possesses good mechanical strength and rigidity.

It is yet a further object of the present invention to provide a doctor blade that can be manufactured efficiently in a variety of ways, including continuous manufacturing processes, such as pultrusion.

These, and other objects and advantages, are achieved by the doctor blade of the present invention.

SUMMARY OF THE INVENTION

The present invention relates to a doctor blade for cleaning a roll face in a papermaking machine, comprising a thermosetting plastic polymer material selected from the group consisting of vinylesterurethanes and polyether amide resins. Other thermosetting plastic polymers can also be used, provided that their glass transition temperature ($T_g$) is at least 20° C. higher than the operating temperature at the blade/roll face interface at any operating speed of which the papermaking machine is capable of being operated. In addition to being able to endure high operating temperatures, the thermosetting plastic polymers of the doctor blades of the present invention also have high impact resistance. Since these materials do not come close to their $T_g$ temperature during operation, blade wear resulting from softening and/or melting is slower. Also, in such a case, the wear takes place in a controlled way without breaking of the tip of the blade. Controlled wear is important in order that the blade should remain sharp through its whole service life. Owing to high impact strength, the blade tip is not broken equally easily if some material adhering to the roll face passes under the blade in a running situation.

Owing to their nature of thermosetting plastic, the thermosetting plastic polymers for use in the doctor blades of the present invention are suitable for being processed by all methods that are used with thermosetting plastic, including pultrusion. Moreover, processing of these materials does not require considerably elevated temperatures, as the processing of thermoplastic resin materials does. In the manufacture of oblong pieces, such as doctor blades, suitability for pultrusion is a highly desirable feature, because it permits continuous manufacture, in which case the overall economy of the manufacture is better and the product is of uniform quality.

In accordance with a preferred embodiment of the invention, the doctor blades are composite structures further comprising reinforcing materials and/or filler materials. The reinforcing materials can be conventional fibre reinforcements, such as glass, carbon or aramide fibers, or structures woven out of said materials or mixtures of said fibre reinforcements. For example, a multi-layer structure can be made using structure fibreglass and carbon fibre reinforcements, where the alignment of said reinforcement fibers vary/alternate in different layers.

BRIEF DESCRIPTION OF THE DRAWINGS

Not applicable.

DESCRIPTION OF THE PREFERRED EMBODIMENTS

In accordance with an embodiment of the invention, the doctor blade comprises a vinylesterurethane. This material is derived from a polyester-based polyol dissolved in styrene, and polyisocyanate. In the first stage of the reaction, when the polyol component reacts with isocyanate, in a what is called chain extension reaction, urethane bonds are formed. In the second stage of the reaction, the double bonds in the polyester polyol react with the styrene as radical polymerization and cross-link a network structure typical of thermoplastic resins in the material.

The resulting polymer, a vinylesterurethane, has a what is called hybrid structure in which there is both a urethane bond known from polyurethanes and a bond typical of vinylesters. The first and the second stage of the reaction take place typically at the same time. There are several different accelerator and initiator systems which can be used to control the speed of the reactions. Through the choice of a specific system and the selection of a given polyester polyol, it is possible to regulate the properties of the resulting vinylesterurethane as desired in view of the specific use to which a doctor blade comprising the vinylesterurethane will be put, and the method by which the blade will be manufactured.

In addition to the good mechanical properties of vinylesterurethanes (strength, modulus and toughness values equal or exceed typical values of polyester/epoxy materials with high toleration of temperature) these polymers are able to withstand high operating temperatures—the HDT temperature is up to 220° C. Moreover, the good mechanical properties of vinylesterurethane and its resistance to degradation caused by contact with other chemicals are retained at elevated temperatures, and it tolerates thermal aging well. Thus, a doctor blade comprising vinylesterurethane is particularly well-suited for use in modem high-speed paper machines, where the temperature at the blade/roll face interface, and hence the surface temperatures of doctor blades, becomes quite high.

The raw-materials used in the production of vinylesterurethanes are typically provided in solution form, and can be processed by means of methods typical of thermosetting plastic. In the manufacture of doctor blades in accordance with the present invention, preferably pultrusion is used. Further possible methods for manufacture of the doctor blades of the present invention are, for example, manufacture (1) by means of prepregs (setting and autoclave treatment), (2) by means of resin injection (RTM), or (3) by means of reactive injection moulding.

Where pultrusion is used, the speed of manufacture with vinylesterurethanes is up to four times higher than with vinylesters, which lowers the cost of manufacture. The adhesion of vinylesterurethanes to different fillers is good, and, for example, ceramic and metallic fillers or cut-off-fibre reinforcements can be employed with the vinylesterurethanes in addition to woven fibre reinforcements.

In accordance with another embodiment of the invention, the doctor blades comprise a thermosetting plastic called a polyether amide, or PEAR (PolyEther Amide Resin= PEAR), which is obtained from a reaction between bisoxazoline and a phenolic compound. The structure of this polymer is illustrated in a formula below describing structural units of polyether amide and structure of cross-linked polymer.

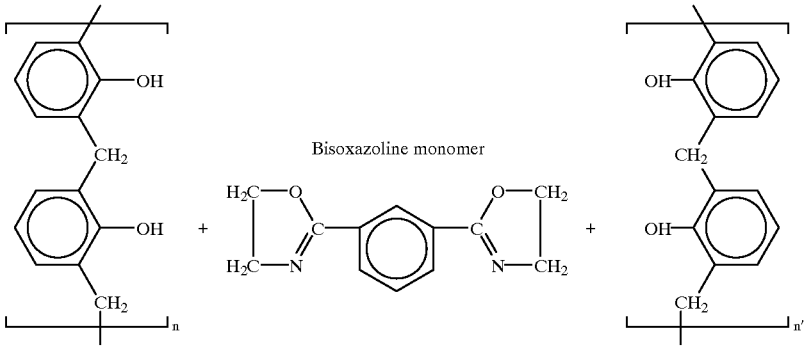

-continued

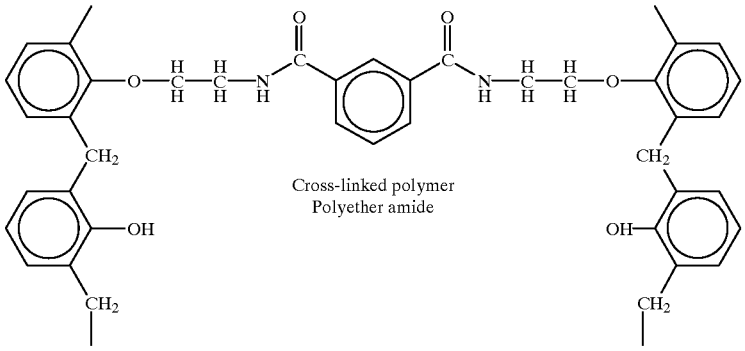

Cross-linked polymer
Polyether amide

The polyether amide polymer illustrated in the formula above has the following properties, which lend themselves to the use of these materials in a doctor blade:

1. excellent thermal stability in constant operation up to 180° C.;
2. goad adhesion to glass fibres, carbon fibres and metals (aluminum, steel) and to ceramics because of its chemical structure
3. good toughness (5-fold $G_{1c}$ value as compared with epoxy);
4. glass transition temperatures generally ranging from 225 to 295° C., depending on the hardening cycle and on the material modification;
5. high modulus of elasticity (pure non-reinforced polyether amide in the category of thermosetting plastics baa a modulus of elasticity of about 5100 MPa);
6. it does not contain volatile components; and
7. low coefficient of thermal expansion ($42\times10^{-6}$/° C.) as compared with other polymers.

Polyether amides are generally available as a solution and as a "hot melt" version. Polyether amide in solution form is, as a rule, used for the preparation of prepregs, in which case fibre reinforcements, if used, are impregnated with a solution that contains a polymer and a suitable solvent. The hot melt polymer is directly useable, for example, in a RTM method or in pultrusion, provided that the components are heated (about 160° C.) in order to lower the viscosity to a suitable level.

In the manufacture of the doctor blades in accordance with the present invention comprising polyether amides, the following techniques can be applied, which techniques are also suitable for other thermosetting plastics: manufacture by means of prepregs (setting and autoclave treatment); pultrusion; compression moulding; and RTM (resin transfer moulding).

From the point of view of doctor blade manufacture, the use of polyether amide accords the following advantages:

1. very low exothermic generation of heat during hardening reaction (5 times lower than with epoxies and 10 times lower than with bismaleimides); even thick parts are possible;
2. low hardening shrinkage (<0.8%; with epoxy about 3%);
3. autoclave treatments at 180° C.; and
4. after-hardening in an oven at 180 to 230° C.

Since polyether amide has good adhesion, among other things, to ceramics and to metals, if necessary or desired various ceramic or metallic filler particles can be mixed with polyether amide in a matrix without considerable deterioration of the mechanical properties of the material.

The present invention also embraces the use of other thermosetting plastic polymer materials besides vinylesterurethanes and polyether amides. Other thermosetting plastic polymer materials can be used in the doctor blades of the present invention, but those materials should have a $T_g$ that is at least 20° C. to 30° C. higher than the operating temperature, i.e., the blade tip temperature, at the blade/roll face interface at the operating speed of the papermaking machine for example a paper machine speed greater than 1400 meters per minute. It should also have high impact resistance, to prevent tip breakage.

It has been noticed that the doctor blades in accordance with the present invention have a remarkably improved resistance to wear and a prolonged service life as compared with blades that contain an epoxy matrix.

While the invention has been described with reference to some preferred embodiments, many modifications and variations are possible within the scope of the inventive idea defined in the following patent claims.

We claim:

1. A doctor blade for use in cleaning a roll in a paper machine, comprising a thermosetting plastic polymer material selected from the group consisting of vinylesterurethanes and polyether amides.

2. The doctor blade of claim 1, where the polymer material is a vinylesterurethane.

3. The doctor blade of claim 1, where the polymer material is a polyether amide.

4. The doctor blade of claim 1, further comprising at least one of reinforcement fibers and filler materials.

5. The doctor blade of claim 4, where the blade is manufactured by pultrusion.

6. A doctor blade for use in cleaning a roll in a paper machine, wherein the doctor blade is comprised of a vinylesterurethane hybrid structure in which there is both a urethane bond known from polyurethanes and a bond typical of vinylesters.

7. The doctor blade of claim 6, further comprising reinforcement fibers.

8. The doctor blade of claim 6, further comprising filler materials.

9. The doctor blade of claim 1 wherein the blade is manufactured by pultrusion.

10. A doctor blade for use in cleaning a roll in a paper machine, comprising a doctor blade made of polyether amide resin.

11. The doctor blade of claim 10, further comprising reinforcement fibers.

12. The doctor blade of claim 10, further comprising filler materials.

13. The doctor blade of claim 11, wherein the blade is manufactured by pultrusion.

14. The doctor blade of claim 10 wherein the polyether amide resin has a glass transition temperature of between 225 and 295° C.

* * * * *

UNITED STATES PATENT AND TRADEMARK OFFICE

CERTIFICATE OF CORRECTION

PATENT NO. : 6,758,944 B2
DATED : July 6, 2004
INVENTOR(S) : Kirjava et al.

It is certified that error appears in the above-identified patent and that said Letters Patent is hereby corrected as shown below:

Title page,
Item [56], References Cited, FOREIGN PATENT DOCUMENTS, "JP 5-132691" should be -- JP 5-132891 --

Column 6,
Line 61, "claim 1" should be -- claim 7 --

Signed and Sealed this

Twenty-third Day of November, 2004

JON W. DUDAS
*Director of the United States Patent and Trademark Office*